US010953283B2

(12) United States Patent
Huber

(10) Patent No.: US 10,953,283 B2
(45) Date of Patent: Mar. 23, 2021

(54) BASE APPARATUS FOR ROTATING A FITNESS BALANCE DEVICE

(71) Applicant: Wendy Lynn Huber, San Jose, CA (US)

(72) Inventor: Wendy Lynn Huber, San Jose, CA (US)

(73) Assignee: CENTER STRENGTH PILATES, LLC, San Jose, CA (US)

( * ) Notice: Subject to any disclaimer, the term of this patent is extended or adjusted under 35 U.S.C. 154(b) by 25 days.

(21) Appl. No.: 16/362,689

(22) Filed: Mar. 25, 2019

(65) Prior Publication Data

US 2019/0290967 A1 Sep. 26, 2019

Related U.S. Application Data

(60) Provisional application No. 62/646,927, filed on Mar. 23, 2018.

(51) Int. Cl.
*A63B 26/00* (2006.01)
*A63B 21/00* (2006.01)
*A63B 41/00* (2006.01)

(52) U.S. Cl.
CPC ..... *A63B 26/003* (2013.01); *A63B 21/4035* (2015.10); *A63B 41/00* (2013.01)

(58) Field of Classification Search
CPC ..... A63B 26/003; A63B 21/4035; A63B 2225/62; A63B 2210/50; A63B 2225/093; A63B 2209/00; A63B 2225/055; A63B 1/00; A63B 22/16; A63B 22/18–20; A63B 2022/185; A63B 41/00–085
See application file for complete search history.

(56) References Cited

U.S. PATENT DOCUMENTS 2,351,293 A * 6/1944 Saunders ..... A63B 22/14 482/147
3,512,774 A * 5/1970 Honer ..... A63B 22/14 482/147
4,117,627 A * 10/1978 Slingerland, Jr. ..... A47G 7/041 108/103
4,290,601 A * 9/1981 Mittelstadt ..... A63B 22/18 472/14
5,683,337 A * 11/1997 Zetocha ..... A63B 22/14 482/146

(Continued)

*Primary Examiner* — Andrew S Lo
(74) *Attorney, Agent, or Firm* — Ashok Tankha; Lipton Weinberger & Husick

(57) ABSTRACT

A base apparatus for accommodating and rotating a fitness balance device for a balance workout routine is provided. The base apparatus comprises a bottom member, a ball bearing plate, a top member, a fastening mechanism, and multiple ball bearings. The ball bearings are disposed in a circular track located on an upper surface of the bottom member. The ball bearing plate is disposed between the bottom member and the top member. Each peripheral hole in the ball bearing plate is configured to accommodate a ball bearing. The top member is in communication with and disposed above the ball bearing plate, and is slidably fastened to the bottom member by the fastening mechanism. The top member comprises a collar for accommodating the fitness balance device, and is configured to rotate relative to the bottom member with the movement of the ball bearings in the circular track of the bottom member.

15 Claims, 14 Drawing Sheets

(56) References Cited

U.S. PATENT DOCUMENTS

| | | | | |
|---|---|---|---|---|
| 7,553,267 | B1 * | 6/2009 | Hauser | A63B 21/00047 482/141 |
| 8,814,768 | B1 * | 8/2014 | Yang | A63B 23/1236 482/147 |
| 9,968,820 | B2 * | 5/2018 | Stockhausen | A63B 21/4035 |
| 9,999,807 | B2 * | 6/2018 | Rainey | A63B 22/16 |
| 10,279,213 | B2 * | 5/2019 | Agostini | A63B 26/003 |
| 10,449,405 | B2 * | 10/2019 | Endelman | A63B 22/14 |
| 2004/0142801 | A1 * | 7/2004 | Lin | A63B 26/003 482/142 |
| 2010/0267533 | A1 * | 10/2010 | Susnjara | A63B 22/20 482/142 |
| 2012/0277078 | A1 * | 11/2012 | Seade | A63B 21/4049 482/142 |
| 2013/0123079 | A1 * | 5/2013 | Peritz | A63B 23/1236 482/139 |
| 2013/0334846 | A1 * | 12/2013 | Bahneman | A47C 9/00 297/195.11 |
| 2014/0155236 | A1 * | 6/2014 | Curry | A63B 69/0093 482/146 |
| 2015/0011369 | A1 * | 1/2015 | Peritz | A63B 21/4035 482/142 |
| 2016/0067541 | A1 * | 3/2016 | Lopez | A63B 21/0618 482/124 |
| 2016/0250520 | A1 * | 9/2016 | Rainey | A63B 26/003 482/146 |
| 2018/0117384 | A1 * | 5/2018 | Endelman | A63B 71/0054 |
| 2019/0175983 | A1 * | 6/2019 | Carr | A63B 21/04 |
| 2019/0232103 | A1 * | 8/2019 | Agostini | A63B 21/4043 |
| 2019/0314676 | A1 * | 10/2019 | Wilson | A63B 22/18 |

* cited by examiner

BASE APPARATUS FOR ROTATING A FITNESS BALANCE DEVICE

CROSS-REFERENCE TO RELATED APPLICATIONS

This application claims priority to and the benefit of provisional patent application titled "Base Apparatus For Rotating A Fitness Balance Device", application No. 62/646,927 filed in the United States Patent Office on Mar. 23, 2018. The specification of the above referenced patent application is incorporated herein by reference in its entirety.

BACKGROUND

The apparatus disclosed herein, in general, relates to fitness devices. More particularly, the apparatus disclosed herein relates to a fitness device attachment that provides additional functionality to a fitness device.

Regular exercise is important for maintaining a healthy life. It is well known that regular exercise helps in maintaining physical fitness, managing weight and improving intellectual functioning. However, a major challenge is that a user's body must be in contact with the floor or other hard surface for performing different forms and types of exercises. Extended periods of contact with hard surfaces, while performing exercises may cause joint pain for many people.

One way of reducing joint pain is by using a fitness ball for exercising. Fitness balls are known by a number of different names, for example, Swiss ball, exercise ball, gym ball, sports ball, fit ball, stability ball, therapy ball, yoga ball, balance ball, body ball, etc. These fitness balls are about 20 to about 30 inches in diameter and are constructed of an elastic material such as rubber or a polymer, and usually inflated with air. In addition for use in exercising, fitness balls are also used in physical therapy.

A major problem with the use of fitness balls for exercising is that users experience difficulty in maintaining their balance when they are on top of the fitness ball. For example, when the user uses a fitness ball for standing, sitting, or lying on top of the fitness ball, the user must continuously balance his body to compensate for the instability of the fitness ball. Therefore, the user must use more muscle movement than used in conventional exercises to maintain balance. Failure to continuously compensate for the instability of the fitness ball increases the chances of unexpected falls, slippage, etc., which in turn increases the risk of injury. Several alternative fitness devices have been introduced in market that attempt to overcome the disadvantages associated with the fitness ball. The Bosu® Balance Trainer of BOSU Fitness, LLC is an example of an alternative fitness device designed to overcome the disadvantages associated with a fitness ball. The Bosu® Balance Trainer, herein referred to as Bosu® ball, comprises an inflated rubber hemisphere attached to a rigid circular base. The Bosu® ball seeks to alleviate undue stress on the user's joints and muscles by reducing muscle movement necessary to maintain the user's balance while using the Bosu® ball. However, the Bosu® ball has certain limitations. For example, the Bosu® ball cannot be rotated when the Bosu® ball is placed on its rigid circular base, thereby preventing the use of Bosu® ball for exercises that require a user to twist his/her body and/or rotate the Bosu® ball.

Hence, there is a long felt yet unresolved need for an apparatus that provides additional functionality to a fitness device. More specifically, there is a long felt but unresolved need for an attachment for the Bosu® ball fitness device that allows a user to perform exercises involving twisting his/her body and/or rotating the Bosu® ball.

SUMMARY OF THE INVENTION

This summary is provided to introduce a selection of concepts in a simplified form that are further disclosed in the detailed description of the invention. This summary is not intended to determine the scope of the claimed subject matter.

A base apparatus for accommodating and rotating a fitness balance device for a balance workout routine is provided. The base apparatus disclosed herein comprises a bottom member for supporting the base apparatus. The bottom member comprises a circular track on an upper surface of the bottom member. The circular track comprises a plurality of ball bearings disposed in the circular track. The base apparatus further comprises a top member positioned above the ball bearing plate. The ball bearing plate is disposed between the top member and the bottom member. The ball bearing plate comprises peripheral holes for accommodating the ball bearings that are disposed in the circular track and which project above the circular track. The top member is disposed above the ball bearing plate, and is in communication with the ball bearing plate. The top member comprises a collar extending along a circumference of an upper surface of the top member for accommodating the fitness balance device on the upper surface of the top member. The base apparatus further comprises a fastening mechanism for slidably fastening the bottom member to the top member.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. The description of a method step or a component referenced by a numeral in a drawing is applicable to the description of that method step or component shown by that same numeral in any subsequent drawing herein.

DETAILED DESCRIPTION OF THE INVENTION

Figure 1A:
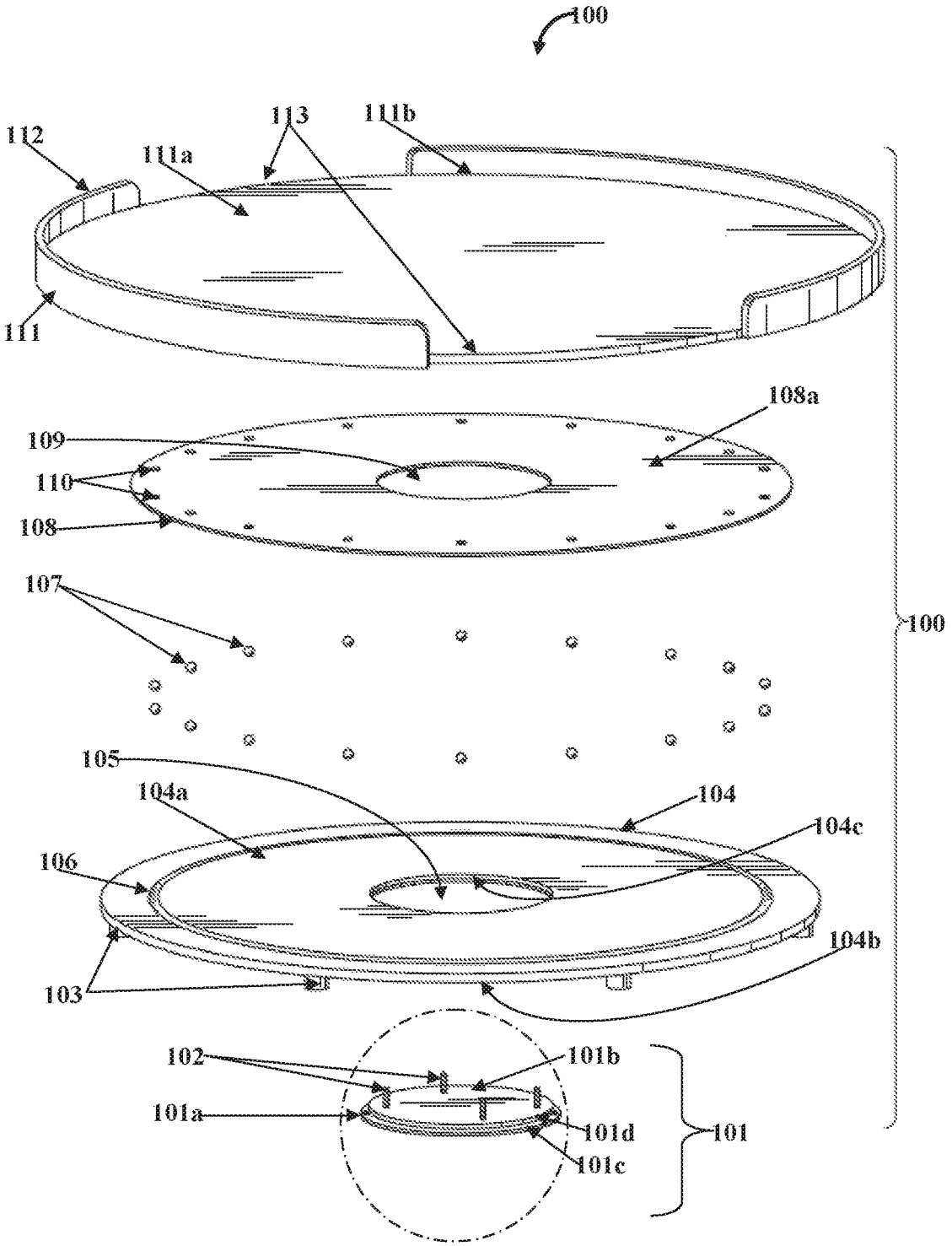
FIG. 1A exemplarily illustrates an exploded, top perspective view of a base apparatus for accommodating and rotating a fitness balance device for a balance workout routine.
Figure 2:
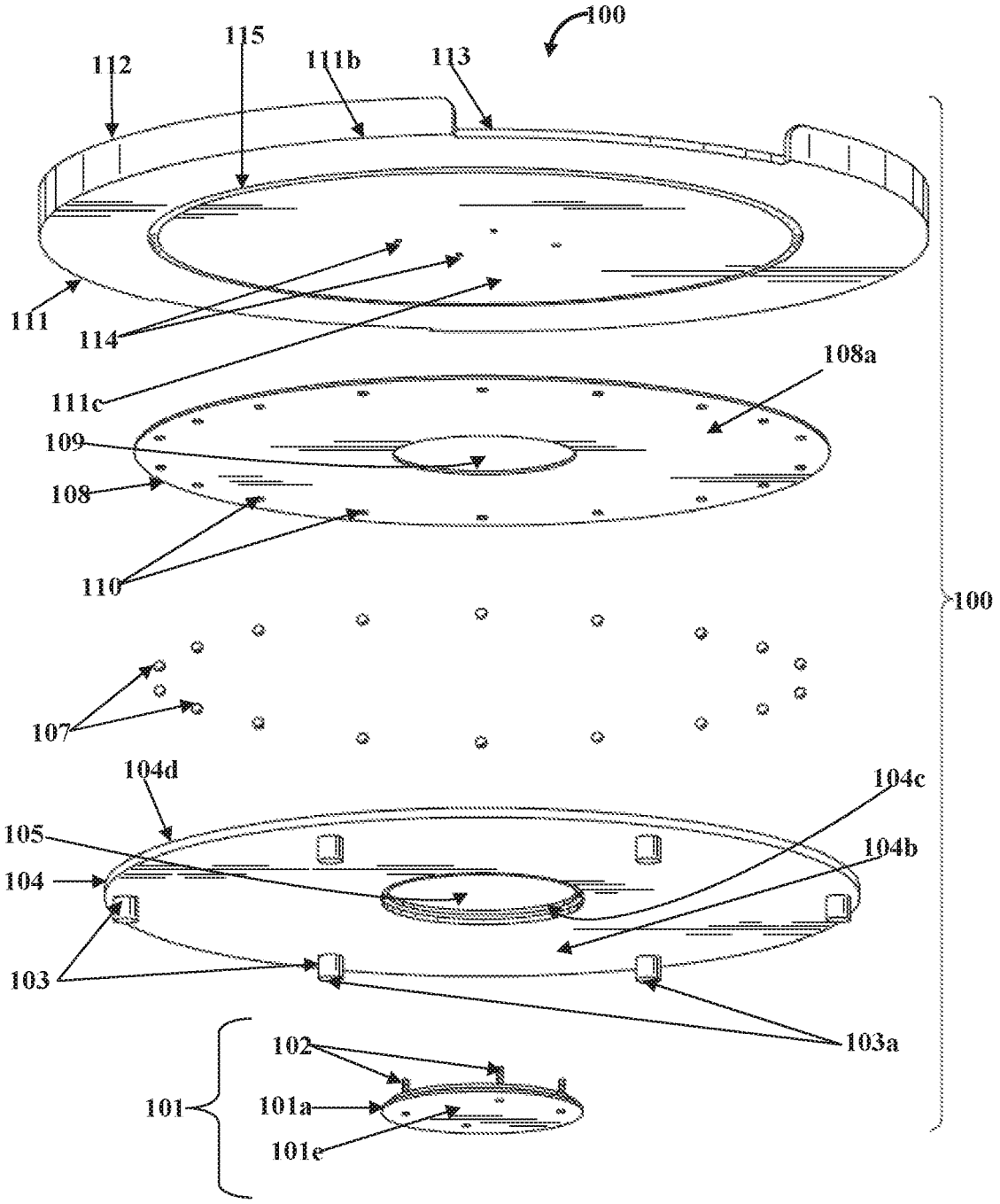
FIG. 2 exemplarily illustrates an exploded, bottom perspective view of the base apparatus.
Figure 3:
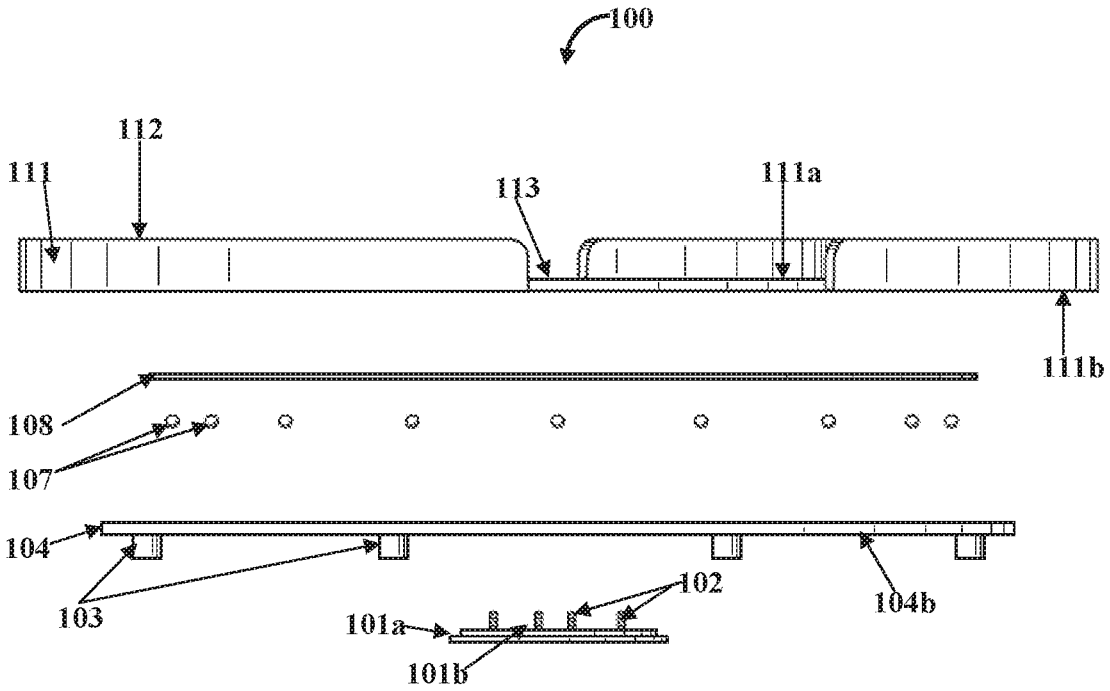
FIG. 3 exemplarily illustrates an exploded, left side elevation view of the base apparatus.
Figure 10:
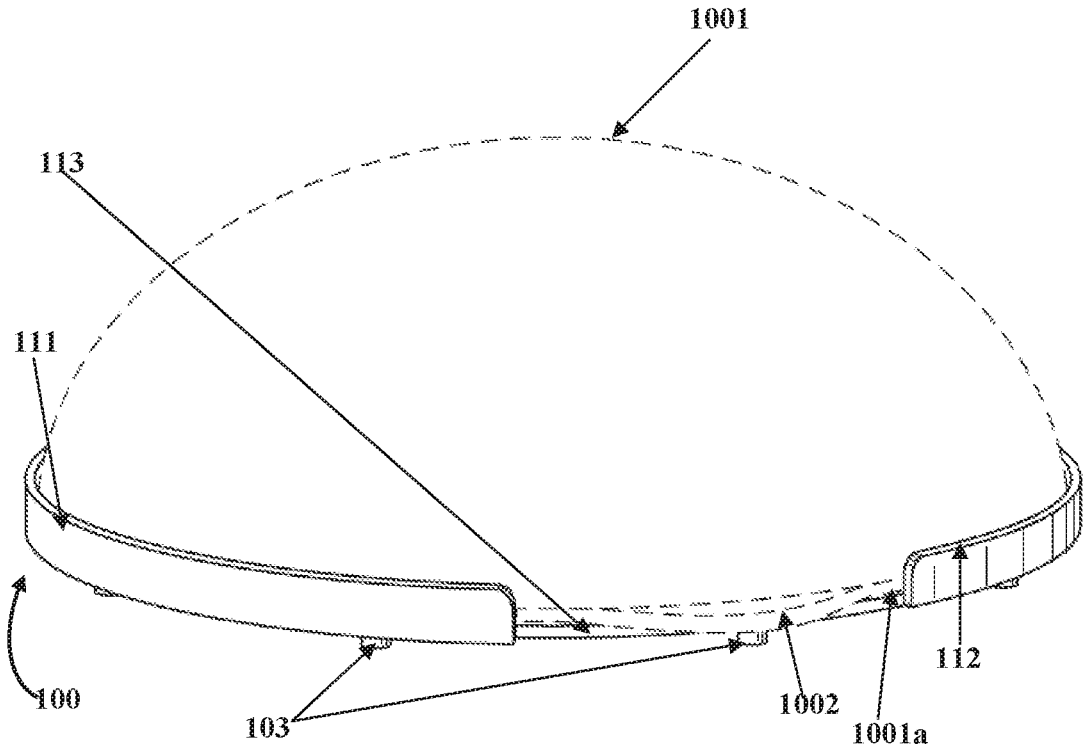
FIG. 10 exemplarily illustrates a top perspective view of the base apparatus, showing a fitness balance device positioned on a top member of the base apparatus.

FIGS. 1A, 2, and 3 exemplarily illustrate exploded views of a base apparatus 100 for accommodating and rotating a fitness balance device 1001 shown in FIG. 10. The fitness balance device 1001 is, for example, a fitness training half ball or a hemispherical ball such as the BOSU® balance trainer or the BOSU® ball of BOSU Fitness, LLC, as exemplarily illustrated in FIG. 10. The fitness balance device 1001 is used for a balanced workout routine.

FIG. 1A exemplarily illustrates an exploded, top perspective view of a base apparatus 100 for accommodating and rotating a fitness balance device 1001 for a balance workout routine. The base apparatus 100 disclosed herein comprises a bottom member 104 for supporting the base apparatus 100, a ball bearing plate 108 disposed between the top member 111 and the bottom member 104, a circular track 106 disposed on an upper surface 104*a* of the bottom member 104, ball bearings 107 disposed in the circular track 106, and a fastening mechanism 101. The ball bearing plate 108 is disposed between the top member 111 and the bottom member 104. The lower surface 108*b* of the ball bearing plate 108 frictionally engages the upper surface 104*a* of the bottom member 104. In an embodiment, the upper surface 108*a* of the ball bearing plate 108 frictionally engages the lower surface 111*c* of the top member 111. In another embodiment, the upper surface 108*a* of the ball bearing plate 108 is disposed on top of the upper surface 104*a* of the bottom member 104 and disposed at a distance from the lower surface 111*c* of the top member 111. The ball bearing plate 108 comprises a central opening 109, and peripheral holes 110 disposed along the periphery of the ball bearing plate 108. The ball bearings 107 are disposed in the circular track 106 and project above the circular track 106. The portion of the ball bearings 107 that project above the circular track 106 are accommodated in the peripheral holes 107 of the ball bearing plate 108. The ball bearings 107 project through and out of the peripheral holes 110 to contact the circular track 106 on the upper surface 104*a* of the bottom member 104 and a circular track 115 on a lower surface 111*c* of the top member 111 as illustrated in FIGS. 1A, 2, 11A, and 11B. The peripheral holes 110 also serve the function of keeping the ball bearings 107 separated from one another and precludes the ball bearings 107 from clumping together when the ball bearings 107 rotate and/or move along the circular track 106.

When a rotational force is applied by a user to the fitness balance device 1001, the ball bearings 107 move along circular tracks 106 and 115 on the bottom member 104 and the top member 111, respectively, and the ball bearing plate 108 rotates on the ball bearings 107 disposed in circular track 106. There are about as many ball bearings 107 disposed in circular track 106 as the number of peripheral holes 110.

In an embodiment, the thickness of the ball bearing plate 108 is about 0.125 inch. The top member 111 is disposed above the ball bearing plate 108. The top member 111 comprises a collar 112 extending along a circumference 111*b* of an upper surface 111*a* of the top member 111 for accommodating the fitness balance device 1001 on the upper surface 111*a* of the top member 111, as exemplarily illustrated in FIG. 10. The fastening mechanism 101 slidably fastens the bottom member 104 to the top member 111. The collar 112 of the top member 111 and wraps around the circumference 111*b* of the upper surface 111*a* of the top member 111.

The number of holes in the ball bearing plate 108 is equal to the number of ball bearings 107, as illustrated in FIGS. 1A, 2, 11A, and 11B. Each portion of the ball bearing 107 that projects above the circular track 106 is accommodated in one of the peripheral holes 110 in the ball bearing plate 108. The diameter of the ball bearings 107 is more than the thickness of the ball bearing plate 108. In an embodiment, the thickness of the ball bearing plate 108 is about 0.125 inch and the thickness of the ball bearings 107 is about 0.5 inch. The ball bearing plate 108 functions to separate the ball bearings 107 from each other such that the ball bearings 107 do not interfere with the movement of one another and do not lump together in the circular track 106. In an embodiment, the peripheral hole 107 has a diameter of about 0.6 inch which allows free movement of the ball bearings 107 in the peripheral hole which have a diameter of about 0.5 inch. In an embodiment, the circular track 106 has a depth of about 0.25 inch. Therefore, in this embodiment, the ball bearings 107 when placed on the circular track 106, project above the circular track 106 by about 0.25 inch. In an embodiment, when the ball bearing plate 108 of about 0.125 inch thickness is disposed on top of the bottom member 104 by accommodating the ball bearings 107 in the peripheral holes 110, the ball bearings 107 project above the ball bearing plate 108 by about 0.125 inch. This 0.125 inch portion of the ball bearings is accommodated in the circular track 115 of the top member 111 which also has a depth of 0.25 inch. The ball bearing plate 108 rests on the bottom member 104 due to gravity. There is sufficient free play between the ball bearings 107 and the peripheral holes 110 of the ball bearing plate 108 which precludes the ball bearing plate 108 from sticking to the ball bearings 107.

When a rotational force is applied by a user to a fitness balance device 1001 disposed on the upper surface 111*a* of the top member 111, the rotational force is transmitted by the top member 111 to the upper surface 108*a* of the ball bearing plate 108, which allows the ball bearing plate 108 to rotate in a clockwise or anti-clockwise direction in accordance with the direction of the rotational force applied by the rotation and/or linear movement of the ball bearings 107 along the circular track 106, thereby allowing the rotation of the fitness balance device 1001.

In an embodiment, the thickness of the ball bearings 107 is 0.65 inch. The peripheral holes 107 in the ball bearing plate 108 have a diameter of 0.75. In this embodiment, the circular track 106 and the circular track 115 have a depth of about 0.25 inch and a width of about 0.65 inch or more. The ball bearings 107 when placed on the circular track 106, project above the circular track 106 by about 0.4 inch. When the ball bearing plate 108 of about 0.125 inch thickness is disposed on top of the bottom member 104 to accommodate the ball bearings 107 in the peripheral holes 110, the ball bearings 107 project above the ball bearing plate 108 by about 0.275 inch. This 0.275 inch portion of the ball bearings is accommodated in the circular track 115 of the top member 111, which also has a depth of about 0.25 inch and width of about 0.65 inch. Since the diameter of the ball bearings is more than the thickness of the ball bearing plate 108, the depth of the circular track 106, and the depth of the circular track 115, the ball bearings 107 are in simultaneous contact with both the circular track 106 of the bottom member 104 and the circular track 115 of the top member 111. Accordingly, in this embodiment, a rotational force applied by a user to the top member 111 is transmitted to the ball bearings 107 which move rotate and/or move along the circular track 115 on the lower surface 111*c* of the top member 111 and the circular track 106 on the upper surface 104*a* of the bottom member 104. The linear movement of the ball bearings 107 along the circular tracks 115 and 106 causes the ball bearing plate 108 to rotate in the direction of movement of the ball bearings 107 each of which is accommodated within a peripheral hole 110 of the ball bearing plate 108. Furthermore, the movement of the ball bearings 107 allows rotation of the top member 111 relative to the bottom member 104.

In an embodiment, the thickness of the ball bearings 107 is more than 0.65 inch and the peripheral holes 107 in the ball bearing plate 108 have a diameter of more than 0.75 i.e., the diameter of the peripheral holes 107 in the ball bearing plate 108 is approximately 0.1 inch greater than the diameter of the ball bearings 107, In an embodiment, the base apparatus 100 comprises about 16 ball bearing 107, where each of the ball bearings 107 is about 0.5 inch in diameter. In another embodiment, the base apparatus 100 comprises more or less than 16 ball bearings.

Figure 1B:
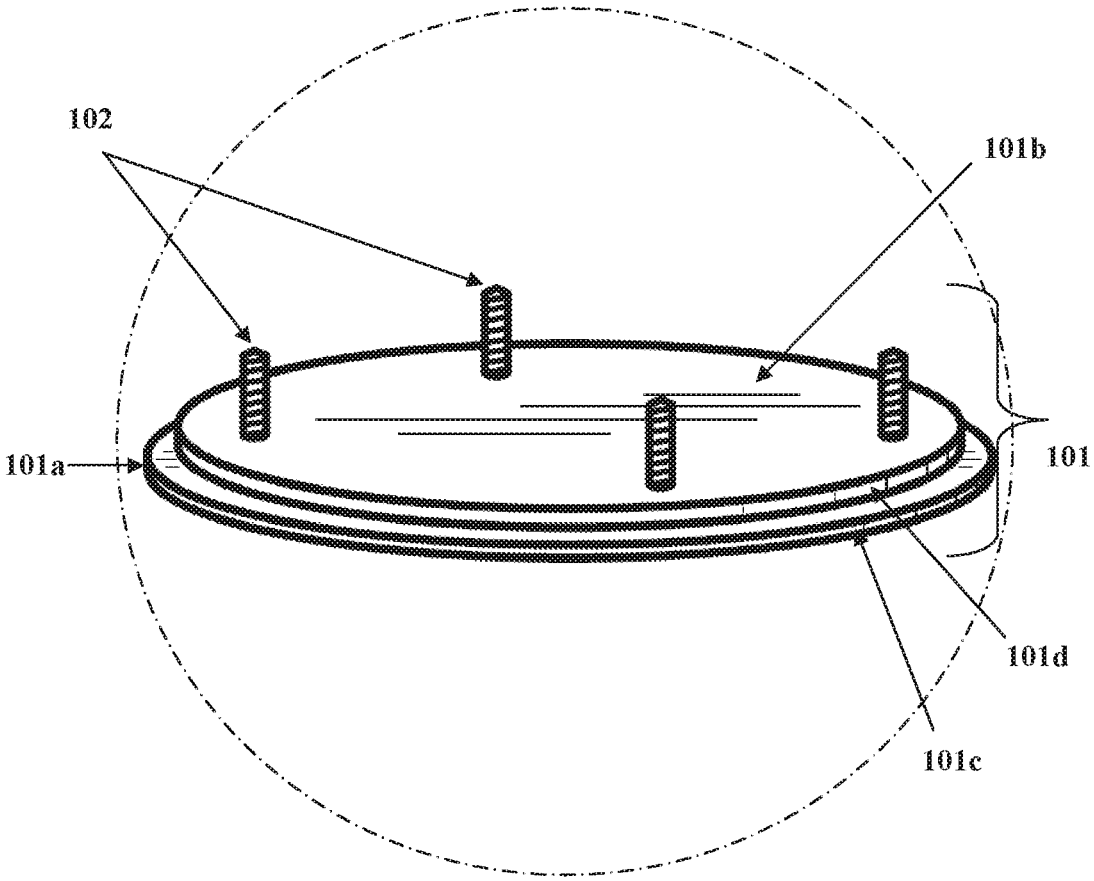
FIG. 1B is an enlarged view of the circled portion shown in FIG. 1A.

In an embodiment, the bottom member 104 comprises a central opening 105. In an embodiment, the diameter of the central opening 109 of the ball bearing plate 108 is about 10 inches and the outer diameter of the ball bearing plate 108 is about 21 inches. The fastening mechanism 101 comprises a fastening plate 101*a* comprising one or more fasteners 102 affixed and substantially perpendicular to the fastening plate 101*a*. In an embodiment, the fastening plate 101*a* comprises about four fasteners 102 located proximal to the periphery of the fastening plate 101*a*. The four fasteners 102, for example, four screws, extend upwardly from an upper surface 101*b* of the fastening plate 101*a*, as exemplarily illustrated in FIGS. 1A, 1B, 2, and 3. In an embodiment, the fastening plate 101*a* is circular in shape, and comprises one or more circular plates with each circular plate concentrically affixed to the circular plate below. In an embodiment, the fastening plate 101*a* comprises a first circular plate 101*c*, and a second circular plate 101*d* concentrically affixed to and positioned above the first plate 101*c*, as illustrated in FIG. 1B. The diameter of the first circular plate 101*c* is larger than the diameter of the second circular plate 101*d*.

The central opening 105 of the bottom member 104 is configured to receive and accommodate the fastening plate 101*a*. The central opening 109 of the ball bearing plate 108 is configured to receive the fastening mechanism 101 with one or more fasteners 102 of the fastening plate 101*a*. A lower surface 111*c* of the top member 111 comprises openings 114, for example, screw holes as exemplarily illustrated in FIG. 2, for receiving and tightening the one or more fasteners of the fastening plate 101*a* for slidably fastening the bottom member 104 to the top member 111. The one or more circular plates 101*c* and 101*d* are adapted to be accommodated within one or more grooves 104*c* located on an inner surface 105*a* of the central opening 105 of the bottom member 104. In an embodiment, the diameter of the first circular plate 101*c* is about 5 inches to about 9 inches, and the diameter of the second circular plate 101*d* is about 4 inches to about 8 inches. Accordingly, in an embodiment, the diameter of the central opening 105 of the bottom member 104 is about 5.1 inches to about 9.1 inches.

FIG. 2 exemplarily illustrates an exploded, bottom perspective view of the base apparatus 100. As exemplarily illustrated in FIG. 2, FIG. 5, and FIG. 8, the base apparatus 100 further comprises gripping feet 103 attached to a lower surface 104*b* of the bottom member 104. In an embodiment, the base apparatus 100 comprises about six gripping feet 103. The gripping feet 103 are, for example, knob like structures that allow the bottom member 104 of the base apparatus 100 to grip a ground surface. The diameter of each of the gripping feet 103 is, for example, about $3/4^{th}$ of an inch. The gripping feet 103 are made of a non-slip material, for example, rubber. In an embodiment, bottom ends 103*a* of the gripping feet 103 are configured to adhere to the ground surface. For example, the bottom ends 103*a* of the gripping feet 103 comprise suctions cups that securely attach the base apparatus 100 to the ground surface.

In an embodiment, the top member 111 is positioned on the ball bearing plate 108. In an embodiment, the circular track 115 on the lower surface 111*c* of the top member 111 is located proximal to a periphery of the lower surface 111*c* of the top member 111. The circular track 115 of the top member 111 and the circular track 106 of the bottom member 104 act as receptacles for the ball bearings 107 to support and accommodate the ball bearings 107 for smooth rotation of the ball bearing plate 108 and in turn the top member 111. In an embodiment, the width of the circular track 106, shown in FIGS. 1A and 11A, and circular track 115, shown in FIGS. 2 and 11B is about 0.5 inch, and an inner diameter of the circular track 106 and circular track 115 is about 18.5 inches. In an embodiment, an outer diameter of the circular track 106 and circular track 115 is about 19.25 inches.

FIG. 3 exemplarily illustrates an exploded, left side elevation view of the base apparatus. The ball bearing plate 108 and the ball bearings 107 positioned between the bottom member 104 and the top member 111 allow varying degrees of rotation of the bottom member 104 with respect to the top member 111, for example, up to 360 degrees. In an embodiment as exemplarily illustrated in FIGS. 1A, 2, and 3, the bottom member 104, the ball bearing plate 108, and the top member 111 are configured as circular discs.

Figure 4:
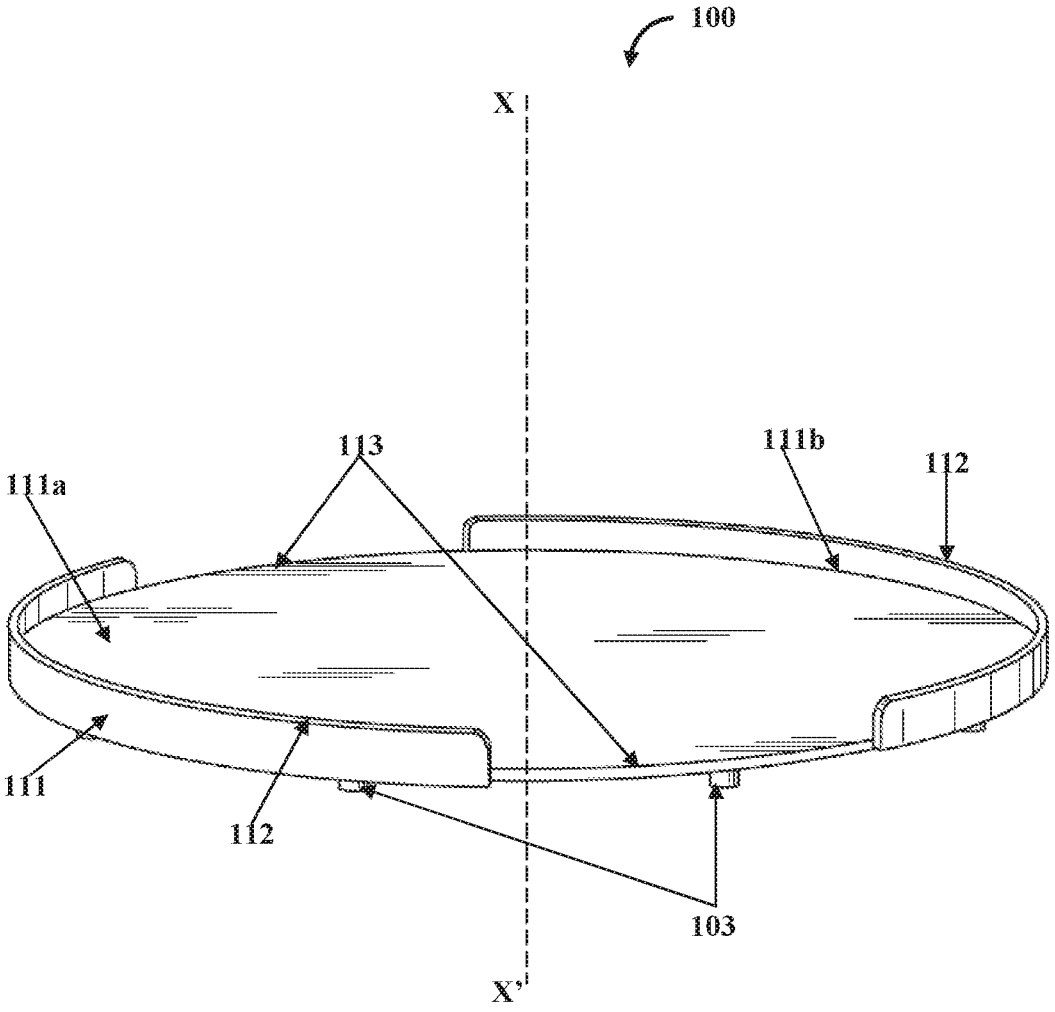
FIG. 4 exemplarily illustrates an assembled, top perspective view of the base apparatus.

FIG. 4 exemplarily illustrates an assembled, top perspective view of the base apparatus 100. The collar 112 of the top member 111 is, for example, about 0.25 inches thick and wraps around the circumference 111*b* of the upper surface 111*a* of the top member 111. In an embodiment, the height of the collar 112 of the top member 111 is about 1 inch.

In an embodiment, the collar 112 of the top member 111 comprises one or more cutouts 113 of, for example, about 7 inches in length each, for receiving and accommodating one or more handles 1002 of the fitness balance device 1001. In another embodiment, the collar 112 of the top member 111 comprises two cutouts 113 located approximately diametrically opposite to each other, as illustrated in FIG. 10. The collar 112 is configured to allow the user of the fitness balance device to accommodate the fitness balance device on the upper surface 111*a* of the top member 111. Furthermore, the collar 112 is configured to secure and hold the fitness balance device 1001 securely by restricting lateral movement of the fitness balance device 1001 accommodated on the upper surface 111*a* of the top member 111. For example, when a user exercises using the fitness balance device 1001 accommodated on the upper surface 111*a* of the top member 111, the collar 112 prevents the fitness balance device 1001 from laterally slipping out of the upper surface 111*a* of the top member 111 when the user exerts a lateral force on the fitness balance device 1001. In an embodiment, the fasteners 102 and the ball bearings 107 are made of, for example, metal, alloy, plastic, composites, etc., and the top member 111, bottom member 104, the ball bearing plate 108, and the fastening plate 101*a* are made of, for example, heavy duty plastic. In another embodiment, the ball bearing plate 108, and the fastening plate 101*a* are made of, for example, metal, alloy, etc.

Figure 5:
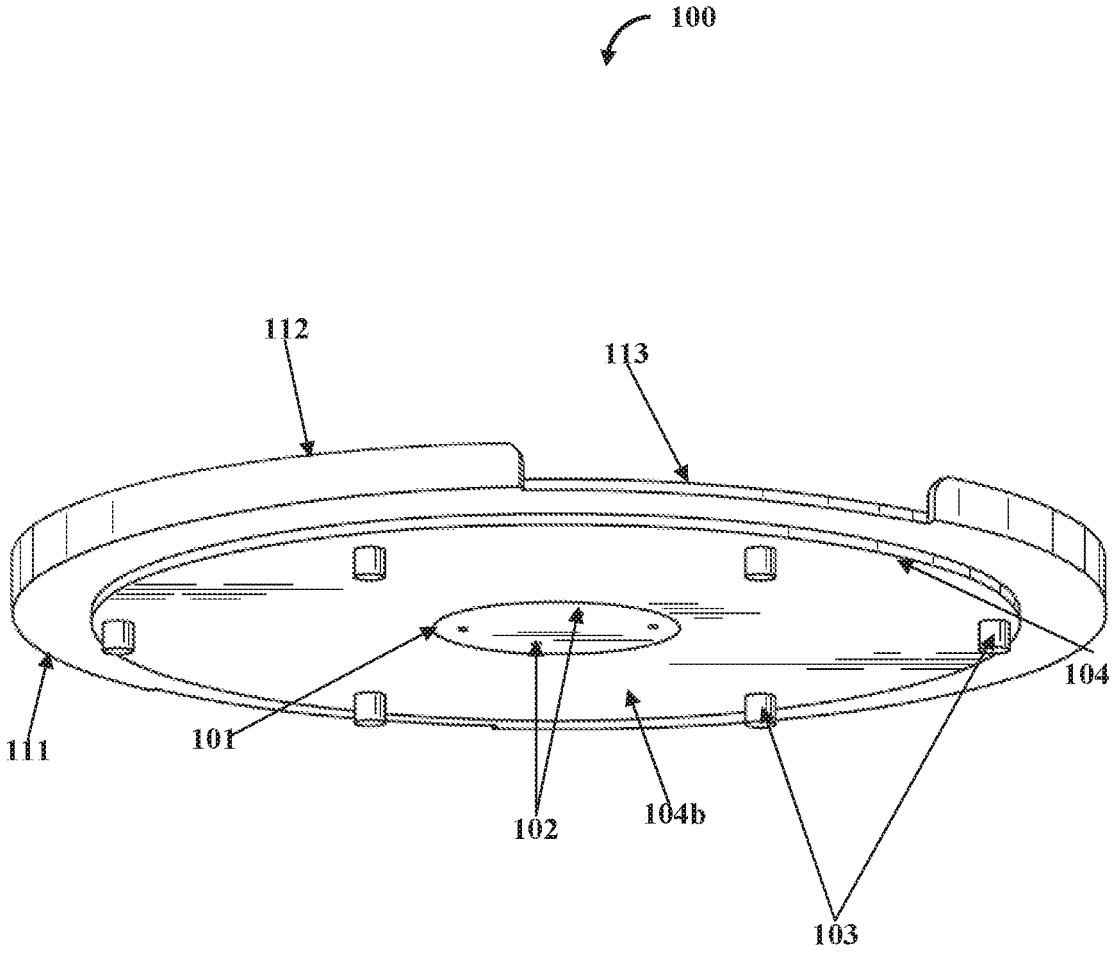
FIG. 5 exemplarily illustrates an assembled, bottom perspective view of the base apparatus.

FIG. 5 exemplarily illustrates an assembled, bottom perspective view of the base apparatus 100. The bottom member 104 supports the base apparatus 100 via the gripping feet 103 on the ground surface. The gripping feet 103 are attached to a lower surface 104*b* as exemplarily illustrated in FIGS. 1A, 2, and 3, of the bottom member 104. In an embodiment, a lower surface 101*e* of the fastening plate 101*a* exemplarily illustrated in FIG. 2, is configured as a non-slip surface for gripping the base apparatus 100 on a ground surface and preventing slippage of the base apparatus 100 on the ground surface. In an alternate embodiment, the gripping feet 103 are detachably attachable to the lower surface 104*b* of the bottom member 104. The fitness balance device 1001 disposed on the upper surface 111*a* of top member 111 of the base apparatus 100 is rotatable in a clockwise or counterclockwise direction about a vertical axis X-X', as illustrated in FIG. 4.

Figure 6A:
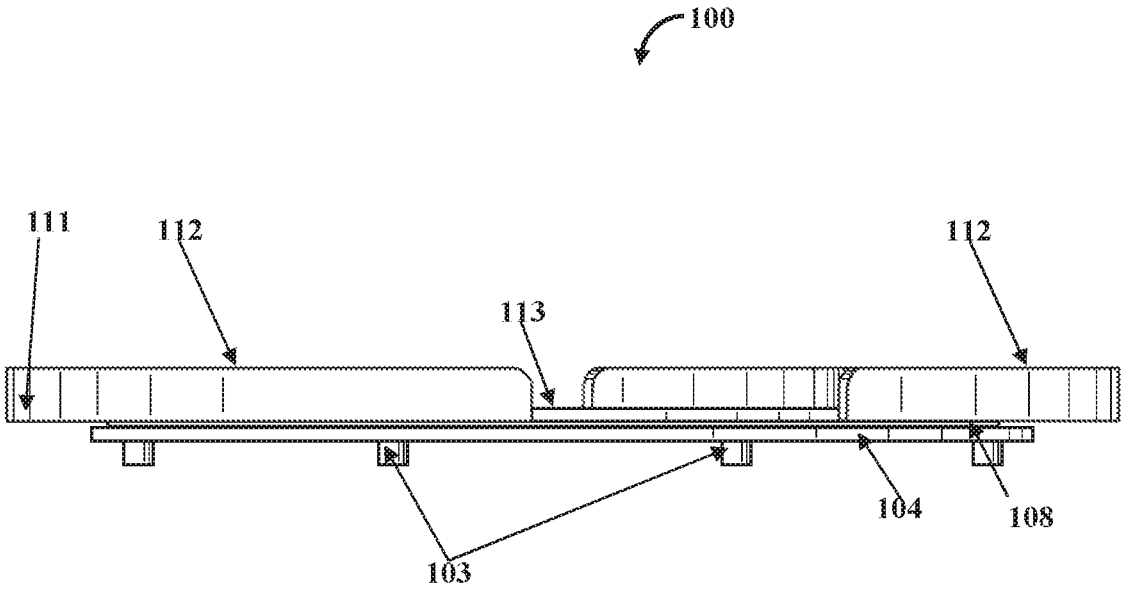
FIG. 6A exemplarily illustrates an assembled, left side elevation view of the base apparatus.
Figure 6B:
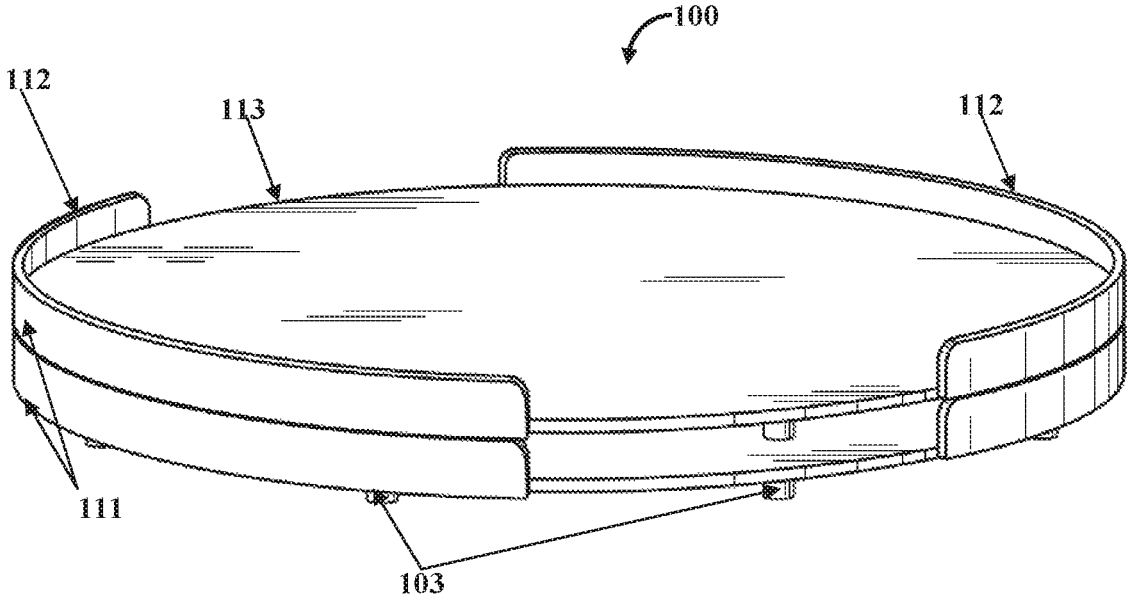
FIG. 6B exemplarily illustrates a top perspective view of the base apparatus stacked on each other for storage purpose.

FIG. 6A exemplarily illustrates an assembled, left side elevation view of the base apparatus 100. The diameter of the top member 111 is larger than the diameter of the bottom member 104 as exemplarily illustrated in FIGS. 1A, 2, and 3. The bottom member 104 is, for example, about 24 inches in diameter, and the top member 111, is, for example, about 26 inches in diameter. In an embodiment, the diameter of the top member 111 is between 20.25 inches to 30.25 inches to accommodate fitness balances devices 1001 having diameters between 20 inches to 30 inches. In this embodiment, the diameter of the bottom member 104 is between 18.25 inches to 28.25 inches. The smaller diameter of the bottom member 104 and the larger diameter of the top member 111 facilitates easy stacking of one base apparatus 100 above another base apparatus 100 for storage purpose, as exemplarily illustrated in FIG. 6B. Furthermore, the top member 111 having the larger diameter substantially extends over the bottom member 104 allowing a user to securely hold the handles of the fitness balance device by the user's hands. The user can wrap his or her fingers around the one or more handles 1002 of the fitness balance device 1001 and the top member 111 without facing interference from the bottom member 104.

In an embodiment, thickness of the bottom member 104 is about 0.5 inch to about 0.75 inch. The thickness of the top member 111 from the upper surface 111*a* to the lower surface 111*c* of the top member 111, excluding the collar 112 is about 0.5 inch to about 0.75 inch. Therefore, total height of the bottom member 104 and the top member 111, excluding the collar 112 of the top member 111 is about 1 inch to about 1.5 inches. The total height of the base apparatus 100 from the top of the collar 112 to the lower surface 104*b* of the bottom member 104 is about 2.375 inches. The total height of base apparatus 100 including the feet is about 3 inches.

Figure 7:
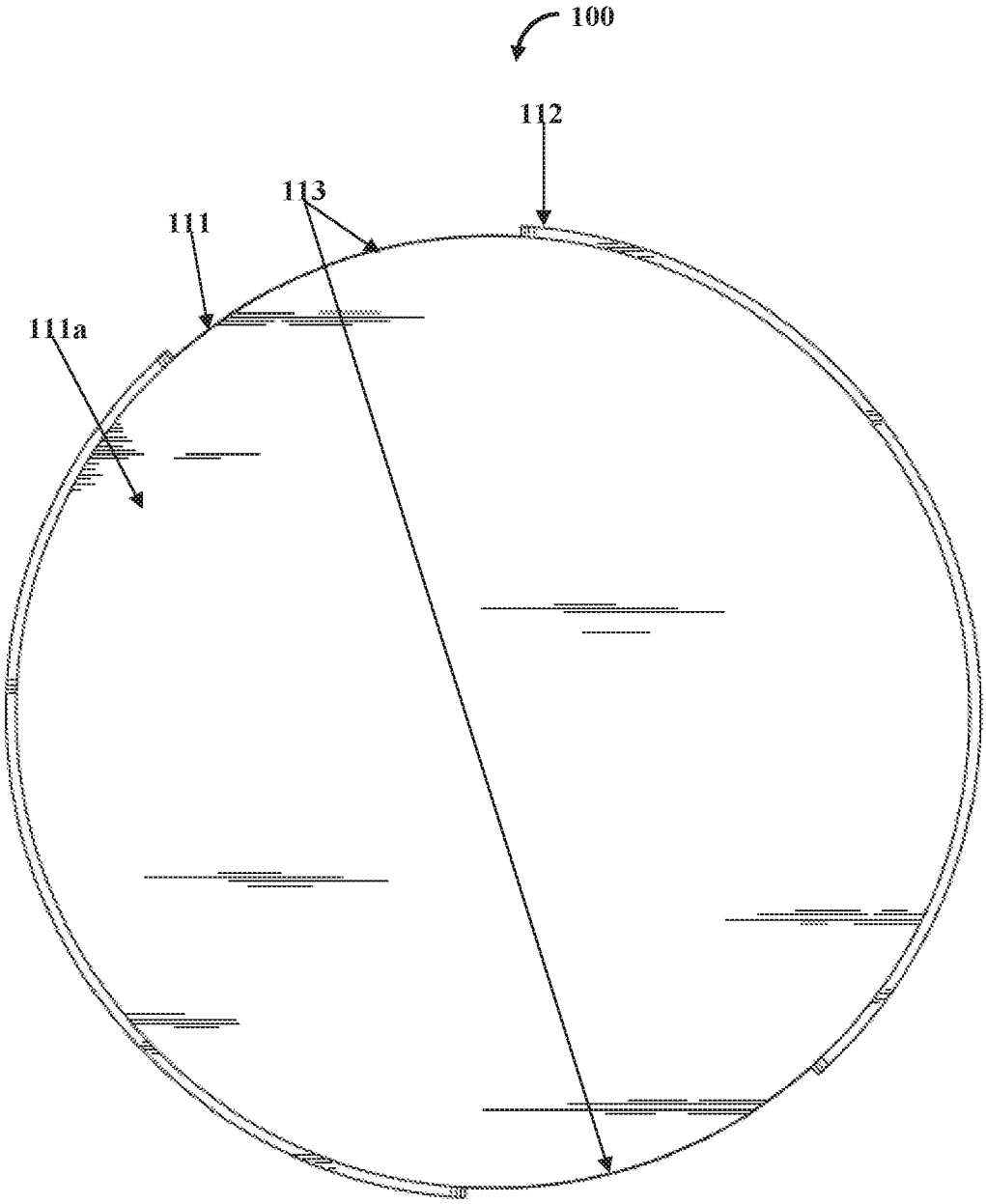
FIG. 7 exemplarily illustrates a top plan view of the base apparatus.
Figure 8:
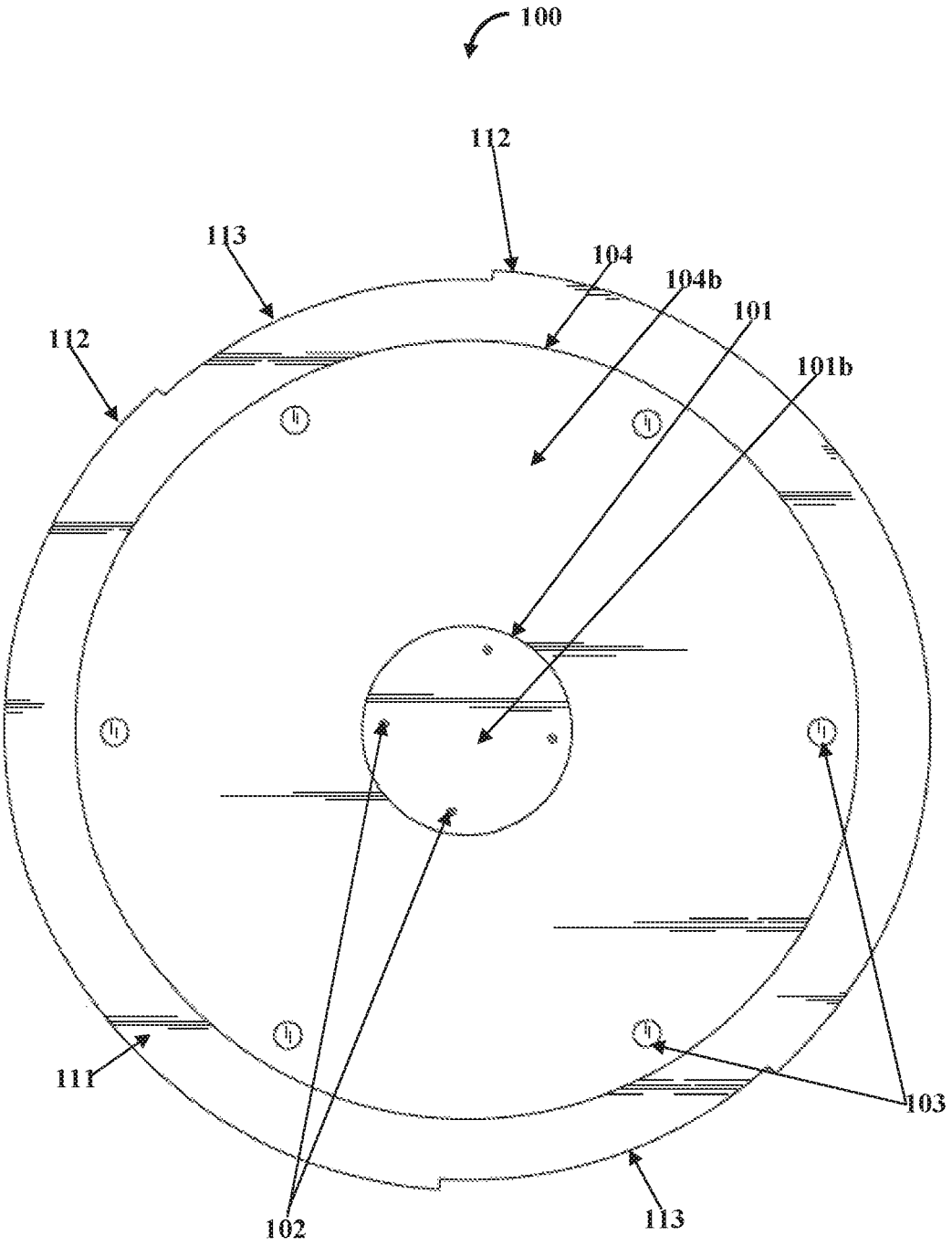
FIG. 8 exemplarily illustrates a bottom view of the base apparatus.
Figure 9A:
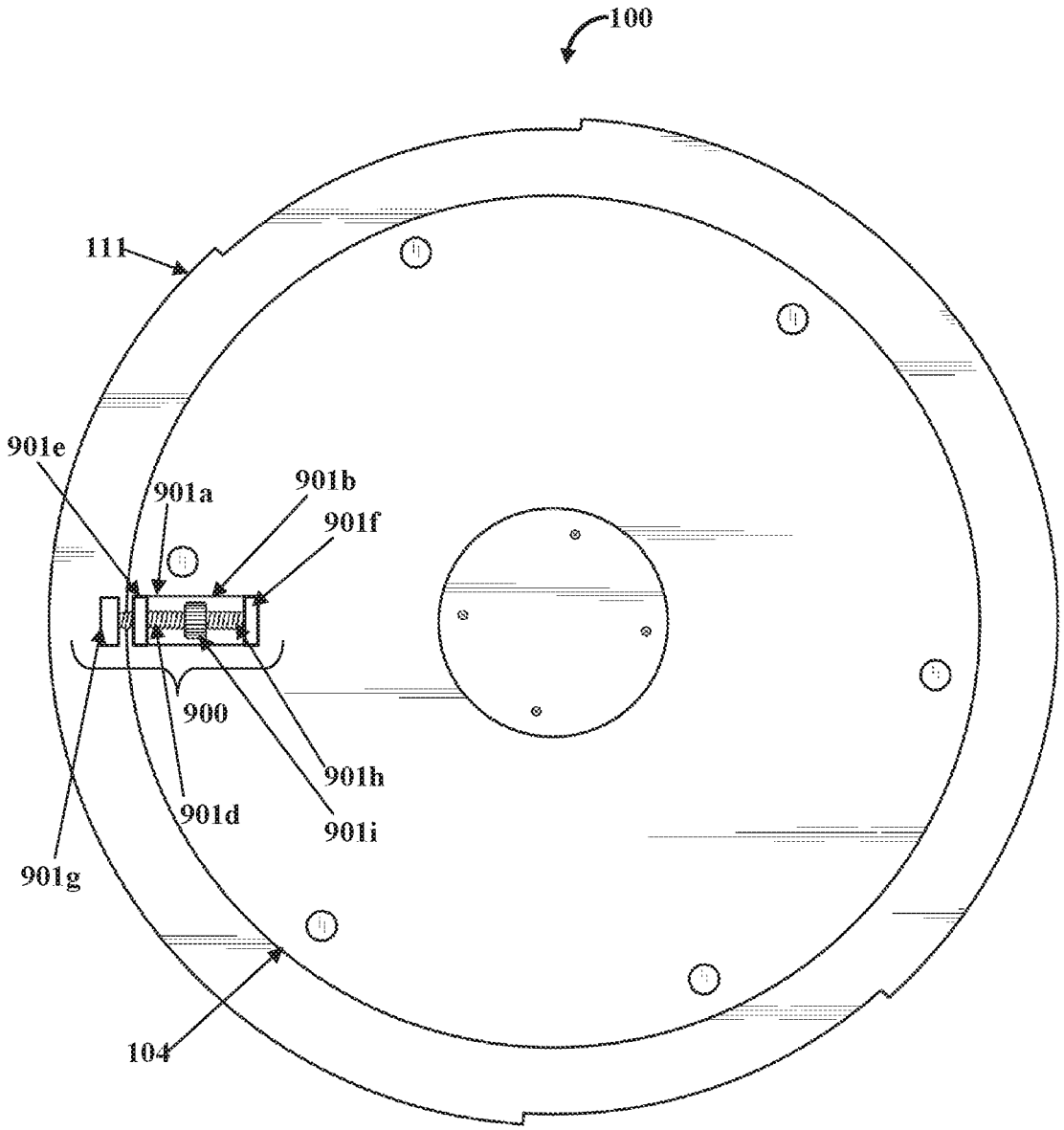
FIG. 9A exemplarily illustrates a bottom view of the base apparatus showing a locking mechanism for locking the top member and the bottom member of the base apparatus.
Figure 9B:
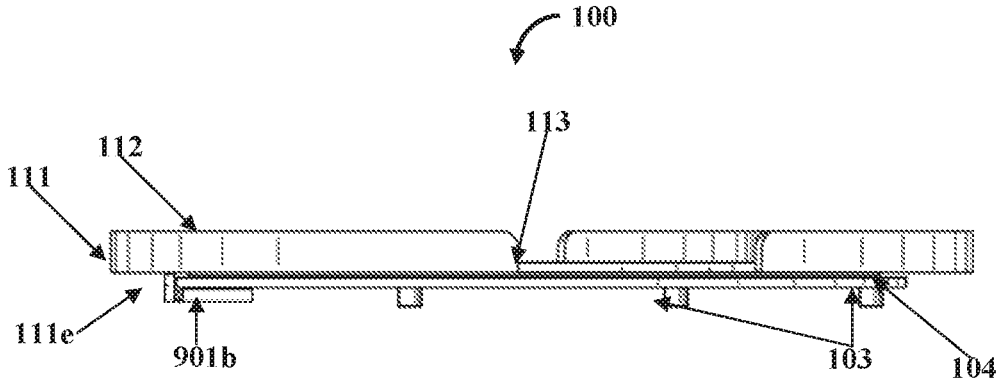
FIG. 9B exemplarily illustrates a front view of the base apparatus showing the locking mechanism.

FIG. 7 exemplarily illustrates a top plan view of the base apparatus 100. FIG. 8 exemplarily illustrates a bottom view of the base apparatus 100. FIG. 9A exemplarily illustrates a bottom view of the base apparatus 100 showing a locking mechanism 900 for locking the top member 111 and the bottom member 104 of the base apparatus 100. FIG. 9B exemplarily illustrates a front view of the base apparatus 100 showing the locking mechanism 900. The locking mechanism 900 comprises a one-nut-stud lock 901*a* and a nut 901*g*. The nut 901*g* comprises a threaded opening therethrough and a plurality of sides surrounding the threaded opening. The nut 901*g* is attached to the lower surface 111*c* of the top member 111 by attaching one of the sides of the nut 901*g* to a periphery of the lower surface 111*c* of the top member 111. The one-nut-stud lock 901*a* is attached to a periphery of the lower surface 104*b* of the bottom member 104. The one-nut-stud lock 901*a* comprises a housing 901*b* and a one-nut-stud 901*c* located in the housing 901*b*. A first threaded portion 901*d* of the one-nut-stud 901*c* is configured to mate with and penetrate the threaded opening of the nut 901*b* to lock the top member 111 to the bottom member 104.

The housing 901*b* comprises a first threaded hole 901*e* located at a first end of the housing 901*b* and a second threaded hole 901*f* located at a second end of the housing 901*b*. The first threaded hole 901*e* accommodates the first threaded portion 901*d* and the second threaded hole 901*f* accommodates a second threaded portion 901*h* of the one-nut-stud 901*c*. The one-nut-stud 901*c* comprises a grip member 901*i* located at a mid-portion of the one-nut-stud 901*c*. The first threaded portion 901*d* is advanced towards the threaded opening of the nut 901*g* by rotating the grip member 901*i* in a clockwise direction.

FIG. 10 exemplarily illustrates a top perspective view of the base apparatus 100, showing a fitness balance device 1001 positioned on the top member 111 of the base apparatus 100. The top member 111 and the bottom member 104 are fastened to each other using the fasteners 102 of the fastening plate 101*a* for accommodating the ball bearing plate 108 with the ball bearings 107 there within, as disclosed in the detailed description of FIGS. 1A, 2, and 3-8. On assembling the base apparatus 100 and supporting the base apparatus 100 on a ground surface via the gripping feet 103, a fitness balance device 1001, for example, a fitness training half ball is positioned on the upper surface 111*a* of the top member 111 exemplarily illustrated in FIG. 10. A rim 1001*a*, illustrated in FIG. 10, of the fitness balance device 1001 is, for example, about 1.25 inches in height. The fitness balance device 1001, when inflated, is, for example, about 10 inches in height. The handles 1002 of the fitness balance device 1001 are inserted into the cutouts 113 of the collar 112 of the top member 111 of the base apparatus 100. The handles 1002 of the fitness balance device 1001 allow a user to rotate the fitness balance device 1001 positioned on the top member 111 of the base apparatus 100 and perform a balance workout routine. The handles 1002 of the fitness balance device 1001 inserted into the cutouts 113 of the collar 112 of the top member 111 of the base apparatus 100 allows the user to secure and utilize the handles 1002 of the fitness balance device 1001.

The base apparatus 100 disclosed herein is used as an accessory to the fitness balance device 1001. The ball bearings 107 accommodated on a circular track 115 of the top member 111 of the base apparatus 100 allows the top member 111, and, in turn, the fitness balance device 1001 to rotate in a transverse plane with respect to the bottom member 104 when the user performs one or more exercises on the fitness balance device 1001, as shown in FIG. 10. Therefore, the base apparatus 100 when used with the fitness balance device 1001 allows a user to perform exercises on the fitness balance device 1001, for example, in a sitting position, a kneeling position, a side-lying position, a prone position, a supine position, a standing position, etc., with the additional functionality of rotation of the fitness balance device 1001, thereby allowing the user to perform movements that cannot be achieved with the fitness balance device 1001 alone.

Figure 11A:
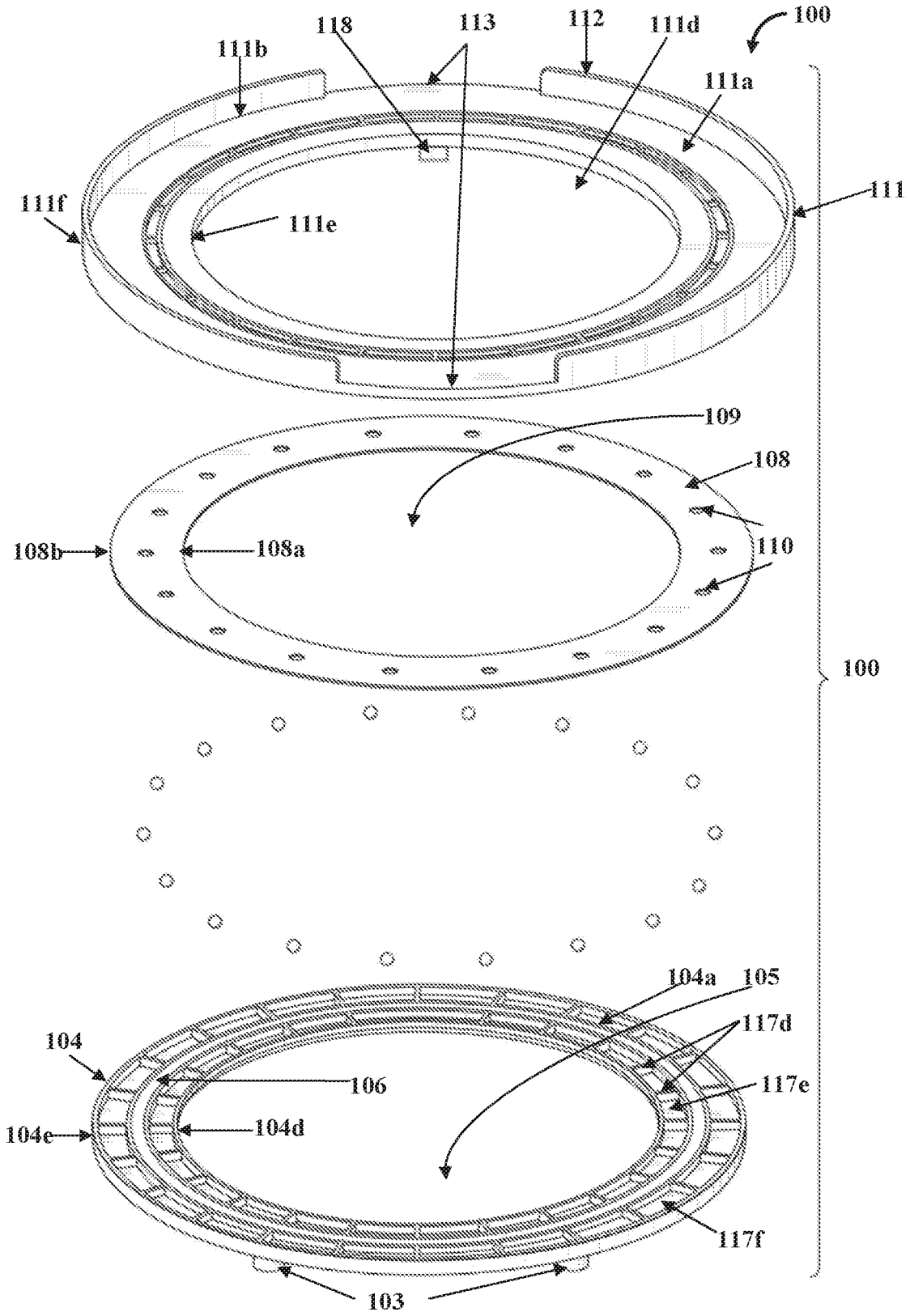
FIGS. 11A-11B exemplarily illustrate an exploded top view and an exploded bottom view of an alternate embodiment of the base apparatus.
Figure 11B:
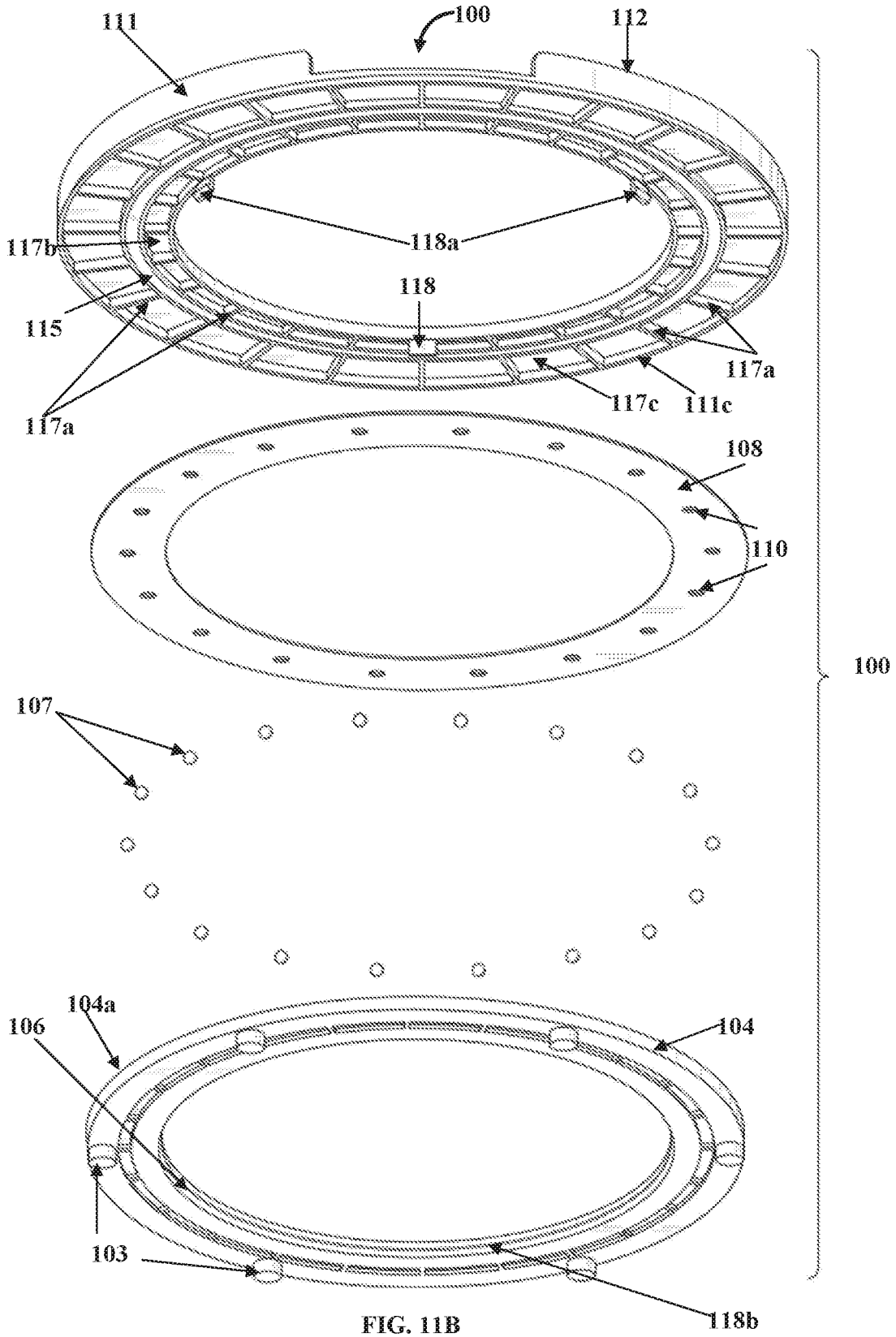

FIGS. 11A and 11B exemplarily illustrate an exploded top view and an exploded bottom view of an alternate embodiment of the base apparatus 100. As exemplarily illustrated in FIG. 11B, the bottom member 104 comprises a central opening 105. Likewise, the ball bearing plate 108 comprises a central opening 109. Similarly, the top member 111 comprises a central opening 111*d*. In an embodiment, the fastening mechanism 101 comprises a plurality of legs 118 projecting downwards from a periphery of the central opening 111*d* of the top member 111. The legs 118 comprise outwardly protruding edges 118*a* configured to slidably lock the top member 111 to a recess 118*b* located on a periphery of the central opening 105 of the bottom member 104, as illustrated in FIG. 11B. The legs 118 are configured to snap-fit the top member 111 to the bottom member 104 of the base apparatus 100.

As exemplarily illustrated in FIGS. 11A and 11B, the bottom member 104 and the top member 111 comprise a plurality of radially outward extending vertical reinforcement ribs 117*a* and 117*d*. The radially outward extending vertical reinforcement ribs 117*a* of the top member 111 are located on a lower surface 111*c* of the top member 111. The radially outward extending vertical reinforcement ribs 117*d* of the bottom member 104 are located on an upper surface 104*a* of the bottom member 104. Further, the vertical reinforcement ribs 117*a* of the top member 111 are arranged continuously in a longitudinally extending circumferentially spaced relationship perpendicular to the circular track 115 in segments 117*b* and 117*c* at the lower surface 111*c* of the top member 111. In a similar manner, the vertical reinforcement ribs 117*d* of the bottom member 104 are arranged continuously in a longitudinally extending circumferentially spaced relationship perpendicular to the circular track 106 in segments 117*e*, 117*f* of the upper surface 104*a* of the bottom member 104.

In an embodiment, the vertical reinforcement ribs 117*a* and 117*d* are about 0.15 inch thick. In another embodiment, the thickness of the vertical reinforcement ribs 117*a* and 117*d* is less than 0.15 inch. Furthermore, in an embodiment, the circular track 115 of the top member 111 and the circular track 106 of the bottom member 104 each have a diameter of about 20.2 inches.

The vertical reinforcement ribs 117*a* and 117*d* enhance structural strength of the base apparatus 100. Furthermore, the vertical reinforcement ribs 117*a* and 117*d*, reduce raw material required to manufacture the base apparatus 100, thereby reducing weight of the base apparatus 100.

The foregoing examples have been provided merely for explanation and are in no way to be construed as limiting of the base apparatus 100 disclosed herein. While the base apparatus 100 has been described with reference to various embodiments, it is understood that the words, which have been used herein, are words of description and illustration, rather than words of limitation. Furthermore, although the base apparatus 100 has been described herein with reference to particular means, materials, and embodiments, the base apparatus 100 is not intended to be limited to the particulars disclosed herein; rather, the base apparatus 100 extends to all functionally equivalent structures, methods and uses, such as are within the scope of the appended claims. While multiple embodiments are disclosed, it will be understood by those skilled in the art, having the benefit of the teachings of this specification, that the base apparatus 100 disclosed herein is capable of modifications and other embodiments may be effected and changes may be made thereto, without departing from the scope and spirit of the base apparatus 100 disclosed herein.

I claim:

1. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member; and a fastening mechanism for slidably fastening said bottom member to said top member, wherein said fastening mechanism comprises a fastening plate comprising one or more fasteners.

2. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member; and a fastening mechanism for slidably fastening said bottom member to said top member, wherein said fastening mechanism comprises a fastening plate comprising one or more fasteners, wherein said fastening plate is circular in shape, wherein said fastening plate comprises a first circular plate and a second circular plate, with said first circular plate and said second circular plate concentrically affixed and positioned above with respect to the circular plate below, wherein a diameter of said first circular plate is larger than diameter of said second circular plate, and wherein said second circular plate is in communication with, and positioned above said first circular plate.

3. The base apparatus of claim 2, wherein said first and second circular plates are adapted to be accommodated within one or more grooves located on an inner surface of said central opening of said bottom member.

4. The base apparatus of claim 2, wherein said bottom member, said ball bearing plate, and said top member are configured as circular discs.

5. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member, wherein said collar of said top member comprises one or more cutouts for receiving and accommodating one or more handles of said fitness balance device, wherein said cutouts are located approximately diametrically opposite to each other, wherein said collar is configured to allow said user of said fitness balance device to accommodate said fitness balance device on said upper surface of said top member, and wherein said collar is configured to hold said fitness balance device securely by restricting lateral movement of said fitness balance device accommodated on said upper surface of said top member; and a fastening mechanism for slidably fastening said bottom member to said top member.

6. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track, and wherein said bottom member further comprises a plurality of gripping feet detachably attached to a lower surface of said bottom member to allow said bottom member to grip a ground surface;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member; and a fastening mechanism for slidably fastening said bottom member to said top member.

7. The base apparatus of claim 6, wherein a lower surface of said top member further comprises a circular track for accommodating said ball bearings disposed in said circular track.

8. The base apparatus of claim 7, wherein said ball bearings are configured to move along said circular track of said top member and said circular track of said bottom member, and wherein said top member is configured to rotate relative to said bottom member with the movement of said ball bearings in said circular track of said top member and said circular track of said bottom member.

9. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member, wherein a diameter of said top member is larger than a diameter of said bottom member for stacking a first base apparatus above a second base apparatus by accommodating said bottom member of said first base apparatus along said top member of said second base apparatus, and wherein said top member having said larger diameter substantially extends over said bottom member allowing a user to securely hold one or more handles of said fitness balance device by said user's hands; and a fastening mechanism for slidably fastening said bottom member to said top member.

10. A base apparatus for accommodating and rotating a fitness balance device for a balance workout routine, said base apparatus comprising:

a bottom member for supporting said base apparatus, said bottom member comprising a circular track on an upper surface of said bottom member, wherein a plurality of ball bearings are disposed in said circular track;

a ball bearing plate disposed between the bottom member and a top member, said ball bearing plate comprising a plurality of peripheral holes, wherein each of said peripheral holes is configured to accommodate one of said ball bearings;

said top member in communication with and disposed above said ball bearing plate, wherein said top member comprises a collar extending along a circumference of an upper surface of said top member for accommodating said fitness balance device on said upper surface of said top member;

a fastening mechanism for slidably fastening said bottom member to said top member; and a locking mechanism, wherein said locking mechanism comprises a one-nut-stud lock and a nut, wherein said nut comprises a threaded opening therethrough and a plurality of sides surrounding said threaded opening, wherein said nut is attached to said lower surface of said top member by attaching one of said sides to a periphery of said lower surface of said top member, wherein said one-nut-stud lock is attached to a periphery of said lower surface of said bottom member, wherein said one-nut-stud lock comprises a housing and a one-nut-stud located in said housing, and wherein a first threaded portion of said one-nut-stud is configured to mate with and penetrate said threaded opening of said nut to lock said top member to said bottom member.

11. The base apparatus of claim 10, wherein said housing comprises a first threaded hole located at a first end of said housing and a second threaded hole located at a second end of said housing, wherein said first threaded hole accommodates said first threaded portion and said second threaded hole accommodates a second threaded portion of said one-nut-stud.

12. The base apparatus of claim 11, wherein said one-nut-stud comprises a grip member located at a mid-portion of said one-nut-stud, wherein said first threaded portion is advanced towards said threaded opening of said nut by rotating said grip member in a clockwise direction.

13. The base apparatus of claim 10, wherein said bottom member comprises a central opening, wherein said ball bearing plate comprises a central opening, and wherein said top member comprises a central opening.

14. The base apparatus of claim 13, wherein said fastening mechanism comprises a plurality of legs projecting downwards from a periphery of said central opening of said top member, wherein said legs comprise outwardly protruding edges configured to slidably lock said top member to a recess located on a periphery of said central opening of said bottom member.

15. The base apparatus of claim 10, wherein said bottom member and said top member further comprise a plurality of radially outward extending vertical reinforcement ribs, wherein said radially outward extending vertical reinforcement ribs of said top member are located on a lower surface of said top member, and wherein said radially outward extending vertical reinforcement ribs of said bottom member are located on an upper surface of said bottom member.

* * * * *